US010408176B2

(12) United States Patent
Coutton et al.

(10) Patent No.: US 10,408,176 B2
(45) Date of Patent: Sep. 10, 2019

(54) FUEL INJECTOR

(71) Applicant: DELPHI TECHNOLOGIES IP LIMITED, St. Michael (BB)

(72) Inventors: Alexandre Coutton, Blois (FR); Cyrille Lesieur, Courbouzon (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 42 days.

(21) Appl. No.: 15/747,779

(22) PCT Filed: Jul. 21, 2016

(86) PCT No.: PCT/EP2016/067426
§ 371 (c)(1),
(2) Date: Jan. 26, 2018

(87) PCT Pub. No.: WO2017/016977
PCT Pub. Date: Feb. 2, 2017

(65) Prior Publication Data

US 2018/0216589 A1 Aug. 2, 2018

(30) Foreign Application Priority Data

Jul. 29, 2015 (GB) ..... 1513309.3

(51) Int. Cl.
*F02M 47/02* (2006.01)
*F02M 63/00* (2006.01)

(52) U.S. Cl.
CPC ..... *F02M 47/027* (2013.01); *F02M 63/007* (2013.01); *F02M 63/0017* (2013.01);
(Continued)

(58) Field of Classification Search
CPC .. F02M 47/02; F02M 47/027; F02M 63/0017; F02M 63/0021; F02M 63/0033;
(Continued)

(56) References Cited

U.S. PATENT DOCUMENTS 5,934,643 A 8/1999 Cooke
6,264,116 B1 * 7/2001 Harcombe ..... F02M 47/027 239/124

FOREIGN PATENT DOCUMENTS

EP 2067980 A1 6/2009
WO 2009043717 A1 4/2009
(Continued)

*Primary Examiner* — Hieu T Vo
(74) *Attorney, Agent, or Firm* — Joshua M. Haines

(57) ABSTRACT

A fuel injector includes control valve for controlling fuel pressure in a control chamber. The control valve includes a valve seat; and a valve member having a valve face for cooperating with the valve seat to control fuel pressure in the control chamber. A return line is provided for returning fuel from the control chamber. An armature connected to the valve member and an actuator is provided for actuating the armature. The armature is disposed in an armature chamber. A deflector is provided in the armature chamber to form a first sub-chamber and a second sub-chamber. The first and second sub-chambers are in fluid communication with each other via a first aperture. A pressure differential is established between the first and second sub-chambers when the valve face lifts from the valve seat promoting the flow of fuel from the second sub-chamber into the first sub-chamber through the first aperture.

12 Claims, 8 Drawing Sheets

(52) U.S. Cl.
CPC .... *F02M 63/0021* (2013.01); *F02M 63/0033* (2013.01); *F02M 63/0073* (2013.01); *F02M 2200/04* (2013.01)

(58) Field of Classification Search
CPC ..... F02M 63/007; F02M 63/0023; F02M 2200/04
See application file for complete search history.

(56) References Cited

FOREIGN PATENT DOCUMENTS

| | | | |
|---|---|---|---|
| WO | 2009047090 | A1 | 4/2009 |
| WO | 2011009667 | A1 | 1/2011 |
| WO | 2011023473 | A1 | 3/2011 |
| WO | 2013004457 | A1 | 1/2013 |
| WO | 2014191127 | A1 | 12/2014 |
| WO | 2015106866 | A1 | 7/2015 |

* cited by examiner

FUEL INJECTOR

CROSS REFERENCE TO RELATED APPLICATIONS

This application is a national stage application under 35 USC 371 of PCT Application No. PCT/EP2016/067426 having an international filing date of Jul. 21, 2016, which is designated in the United States and which claimed the benefit of GB Patent Application No. 1513309.3 filed on Jul. 29, 2015, the entire disclosures of each are hereby incorporated by reference in their entirety.

TECHNICAL FIELD

The present disclosure relates to a fuel injector; and to a control valve for a fuel injector.

BACKGROUND

Fuel injectors are used to inject fuel into the combustion chambers of internal combustion engines. A fuel injector typically comprises an injector body, an injector nozzle and an injector needle. The injector needle is movable relative to a nozzle seat formed in the injector nozzle to control the injection of fuel into the combustion chamber. One technique for controlling operation of the injector needle utilises a control valve to control the fuel pressure in a control chamber. The control valve typically comprises a control valve member for controlling fluid communication between the control chamber and a backleak circuit. The control valve member has a valve face for cooperating with a valve seat. The control valve member is fixedly connected to an armature which is disposed in an armature chamber. An electro-mechanical actuator generates a magnetic field to displace the armature, thereby controlling operation of the control valve. The actuator is operable to control the control valve member to lift the valve face from the valve seat to open the control valve; and to seat the valve face in the valve seat to close the control valve.

When the control valve opens, high pressure fuel enters the armature chamber from the control chamber. The introduction of fuel into the armature chamber can cause cavitation in the fuel and/or apply a jet impact force on the armature. These can affect operation of the control valve, for example resulting in variations in the operation of the control valve in a series of injections.

At least in certain embodiments the fuel injector according to the present invention seeks to overcome or ameliorate at least some of the aforementioned problems.

SUMMARY OF THE INVENTION

Aspects of the present invention relate to a fuel injector; and to a control valve for a fuel injector.

According to a further aspect of the present invention there is provided a fuel injector comprising:

a control valve for controlling fuel pressure in a control chamber, the control valve comprising:

a valve seat;

a valve member having a valve face for cooperating with the valve seat to control fuel pressure in the control chamber;

a return line for returning fuel from the control chamber;

an armature connected to the valve member, the armature being disposed in an armature chamber;

an actuator for actuating the armature; and a deflector disposed in the armature chamber to form a first sub-chamber and a second sub-chamber, the first and second sub-chambers being in fluid communication with each other via at least one first aperture;

wherein, in use, a pressure differential is established between the first and second sub-chambers when the valve face lifts from the valve seat promoting the flow of fuel from the second sub-chamber into the first sub-chamber through said at least one first aperture. When the control valve opens, pressure energy in the fuel in the control chamber is converted into kinetic energy by accelerating the fuel into the first sub-chamber. The fuel flows through the first sub-chamber at a relatively high velocity, resulting in a lower pressure.

The fuel flows through the first sub-chamber at high velocity, thereby establishing a Venturi effect in the first sub-chamber. The Venturi effect can establish a region of relatively low pressure in the first sub-chamber which promotes the flow of fuel from the second sub-chamber into the first sub-chamber via the first aperture. The fuel flow through the second sub-chamber can thereby be increased. The at least one first aperture can be positioned proximal to the low pressure region established by the Venturi effect.

The at least one first aperture can be configured to establish communication between radially inner ends of the first and second sub-chambers. The at least one first aperture can be disposed proximal to said valve seat. The at least one first aperture can comprise one or more aperture formed in the deflector. For example, a plurality of holes could be formed in the deflector. Alternatively, or in addition, the at least one first aperture can be formed between the deflector and the valve member. The at least one first aperture can be an annular aperture extending circumferentially around the valve member. The at least one first aperture can extend partially or completely around the valve member. The first aperture can have a radial width in the range 0.0325 mm to 0.2825 mm inclusive. More particularly, the first aperture can have a radial width in the range 0.0825 mm to 0.1825 mm inclusive.

When the control valve opens, a jet of fuel is introduced in the first sub-chamber. The jet of fuel impacts the deflector. The deflector and/or the valve member can be configured such that the at least one first aperture is spaced apart from a jet impact location on the deflector. A distance between the jet impact location and the at least one first aperture can be between 0.3 mm and 0.5 mm (inclusive). The distance can be measured in a radial direction. At least in certain embodiments, the at least one first aperture can be disposed radially inwardly of the jet impact location. The fuel flow through the first sub-chamber can be in a radially outward direction.

The fuel injector can comprise at least one second aperture to facilitate circulation between the first and second sub-chambers. The at least one second aperture can be formed remote from the first aperture. The valve seat and the at least one second aperture can be formed at opposing ends of the armature chamber. The at least one second aperture can be a clearance gap between the deflector and the valve body. The at least one second aperture can have a longitudinal dimension of at least 0.05 mm.

The control valve can open into the first sub-chamber. The first sub-chamber can be formed between the deflector and a valve body. The second sub-chamber can be formed between the deflector and the armature. By establishing a pressure differential between the first and second sub-chambers, the flow of fuel through the second sub-chamber can be increased.

The valve member can comprise a hollow valve stem. A longitudinal bore can be formed in the valve member. The longitudinal bore can have first and second ends which are both open. The first end of the longitudinal bore can open into a collection chamber. The collection chamber can be disposed below the control valve member. The collection chamber can be closed; or can be connected to the return line. The longitudinal bore can extend through the armature. The second end of the longitudinal bore can open into a chamber disposed above the armature. The chamber can, for example, be a spring chamber for housing an actuator spring. At least one third aperture can be maintained between the actuator and the armature when the control valve is open. The chamber formed above the armature can be maintained in fluid communication with the armature chamber via the at least one third aperture. Thus, the collection chamber can be in fluid communication with the armature chamber. The at least one third aperture can comprise a clearance between an upper face of the armature and an opposing face of the actuator. The clearance can, for example, be maintained by a stop member to inhibit lift of the valve member. The clearance between an upper face of the armature and an opposing face of the actuator can be between 0.01 and 0.06 mm. Alternatively, or in addition, one or more aperture can be formed in the upper face of the armature and/or the opposing face of the actuator.

An underside of the deflector can be spaced apart from a bottom of the armature chamber by a longitudinal offset in the range 0.3 mm to 0.4 mm.

BRIEF DESCRIPTION OF THE DRAWINGS

One or more embodiments of the present invention will now be described, by way of example only, with reference to the accompanying figures, in which.

DETAILED DESCRIPTION

A fuel injector 1 for delivering fuel into a combustion chamber (not shown) of an internal combustion engine in accordance with an embodiment of the present invention will now be described. The fuel injector 1 has particular application in a compression-ignition engine (i.e. a diesel engine), but aspects of the present invention could be implemented in a fuel injector for a spark-ignition engine (i.e. a gasoline engine).

Figure 1:
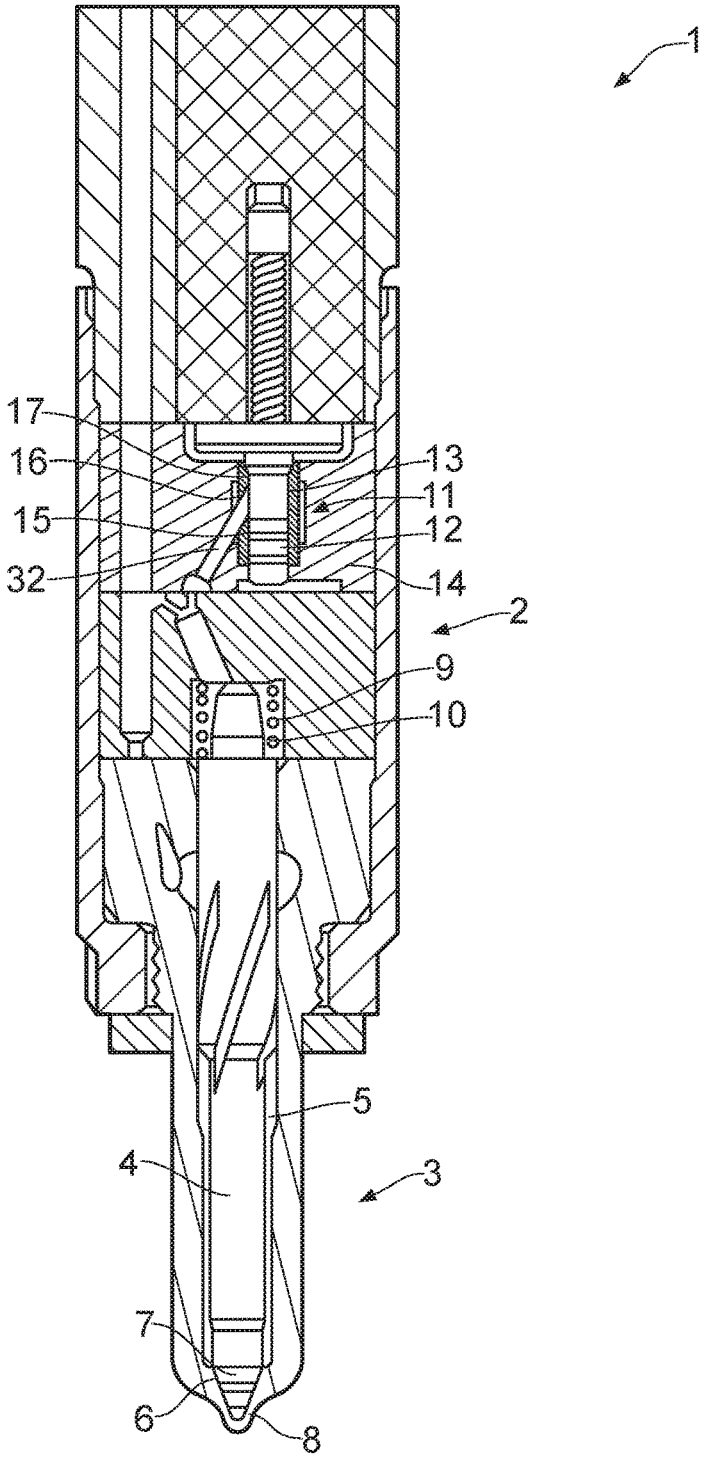
FIG. 1 shows a sectional view through a fuel injector in accordance with an aspect of the present invention.

With reference to FIG. 1, the fuel injector 1 comprises an injector body 2 (also referred to as a nozzle holder body), an injector nozzle 3 and an injector needle 4. The injector needle 4 is movably mounted within an injection chamber 5 formed in the injector nozzle 3. A nozzle seat 6 is formed in the injector nozzle 3 for cooperating with a needle valve 7 disposed at a distal end of the injector needle 4. The injector nozzle 3 comprises a plurality of injection apertures 8 through which fuel is injected into the combustion chamber. As described herein, the injector needle 4 is displaced relative to the nozzle seat 6 to control the injection of fuel into a combustion chamber (not shown) of an internal combustion engine (not shown). The injection apertures 8 are not fuelled when the needle valve 7 is seated in the nozzle seat 6 and are fuelled when the needle valve 7 is unseated from the nozzle seat 6. A first spring 9 is provided in a first spring chamber 10 for biasing the needle valve 7 towards the nozzle seat 6 so as not to fuel the injection apertures.

Figure 2:
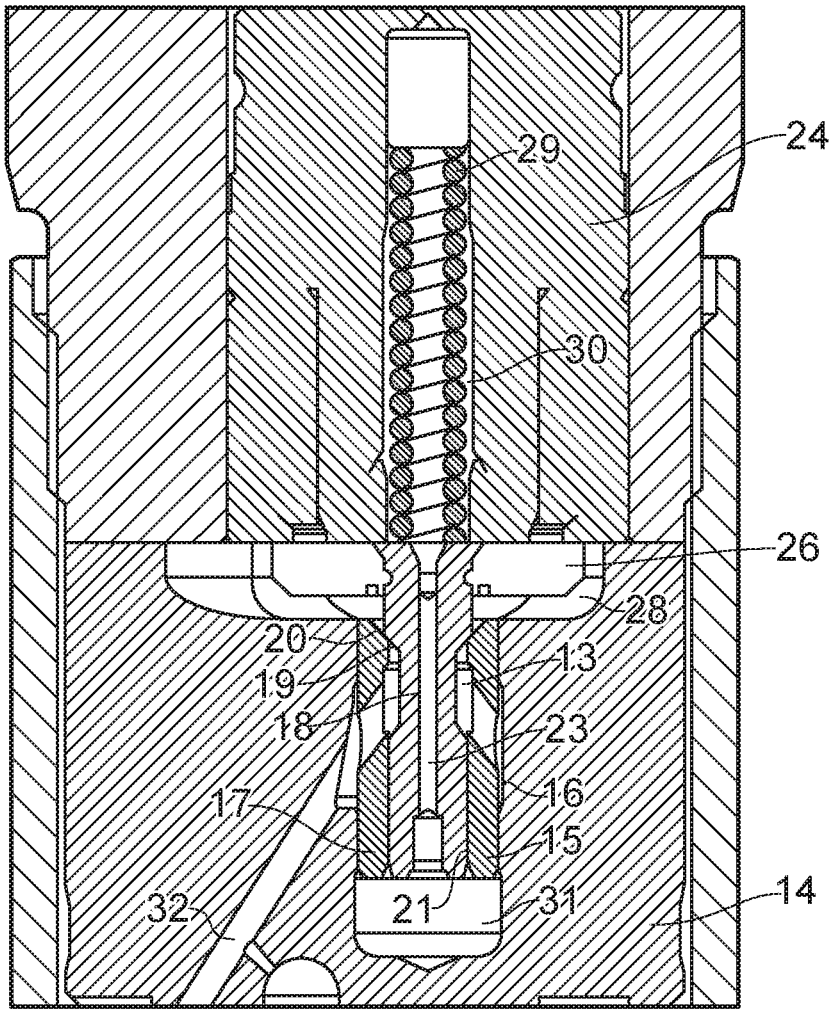
FIG. 2 shows an enlarged view of the control valve of the fuel injector shown in FIG. 1.
Figure 3:
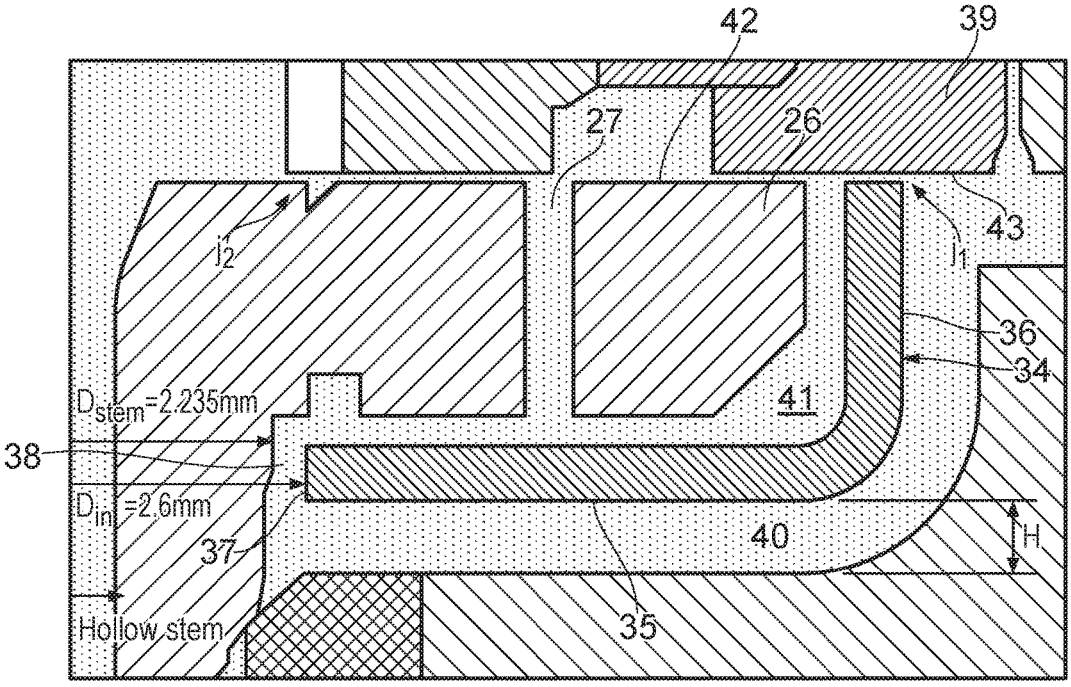
FIG. 3 shows the deflector disposed in the armature chamber of the control valve shown in FIG. 2.

With reference to FIGS. 2 and 3, the fuel injector 1 comprises a control valve 11 for controlling the injector needle 4. The control valve 11 comprises a control valve member 12 disposed in a control chamber 13 formed in a valve body 14. A cylindrical insert 15 is mounted in a bore formed in the valve body 14 to form the control chamber 13. An annular pressure compensating chamber 16 is formed between the cylindrical insert 15 and the valve body 14 to help reduce hydraulic deformation of the cylindrical insert 15. The control valve member 12 comprises a guide barrel 17 and a stem 18. A conical valve face 19 is formed above the stem 18 for locating in a control valve seat 20 to close the control valve 11. The control valve seat 20 has an outwardly tapered conical profile. A sidewall 21 of the cylindrical insert 15 forms a guide for the guide barrel 17. The control valve member 12 is movable along a longitudinal axis X of the control valve 11 to open and close the control valve 11. In the present embodiment, the control valve member 12 is hollow. In particular, a longitudinal through bore 23 extends along the longitudinal axis X of the control valve member 12.

An electro-mechanical actuator 24 is provided to actuate the control valve 11 selectively to control the return of fuel to a low pressure backleak circuit (denoted generally by the reference numeral 25). In the present embodiment, the actuator 24 is in the form of a solenoid actuator. The actuator 24 is arranged to cooperate with an armature 26 fixedly mounted to the control valve member 12. The armature 26 comprises a plurality of through-flow channels 27 extending through the armature 26. The armature 26 is disposed in an armature chamber 28 formed in the valve body 14. As described herein, the armature chamber 28 is in fluid communication with the backleak circuit 25. When the actuator 24 is energized, the armature 26 is displaced towards the actuator 24 and the valve face 19 lifts from the control valve seat 20, thereby placing the control chamber 13 in fluid communication with the backleak circuit 25 via the armature chamber 28. In the orientation illustrated in FIG. 1, the armature 26 is mounted to an upper end of the control valve member 12 and is displaced upwardly when the actuator 24 is energized. The actuator 24 comprises a second spring 29 disposed in a second spring chamber 30. The second spring 29 is operative to bias the valve face 19 towards the control valve seat 20 to close the control chamber 13 when the actuator 24 is de-energized. A collection chamber 31 is formed below the control valve 11 to collect fuel leakage between the guide barrel 17 and the sidewall 21 of the control chamber 13.

A high pressure fuel supply line supplies fuel from a high pressure fuel rail (not shown) to the injector nozzle 3. The control chamber 13 is in fluid communication with the high pressure fuel supply line via a supply line 32. In use, the fuel injector 1 is electrically activated to inject a controlled amount of fuel into a combustion chamber. The actuator 24 is electrically energized to displace the control valve member 12 such that the valve face 19 lifts from the control valve seat 20. The control chamber 13 is thereby connected to the backleak circuit 25 and the pressure in the control chamber 13 is reduced. The needle valve 7 lifts from the nozzle seat 6, thereby fuelling the injection apertures 8. When the actuator 24 is de-energized, the second spring 29 displaces the control valve member 12 such that the valve face 19 is seated in the control valve seat 20. The fluid communication between the control chamber 13 and the backleak circuit 25 is inhibited and the pressure in the control chamber 13 increases. The needle valve 7 is seated in the nozzle seat 6 and the injection apertures 8 are not fuelled. This process is referred to herein as an injection event.

With reference to FIG. 3, a deflector 34 is disposed within the armature chamber 28 to partially encapsulate the armature 26. The deflector 34 is fixedly mounted in the armature chamber 28. For example, the deflector 34 can be connected to the valve body 14 or to the actuator 24. The deflector 34 is operative to deflect fuel entering the armature chamber 28 away from the armature 26. The deflector 34 can help to reduce perturbations around the armature 26 (for example, resulting from cavitation or jet impact force) when the control valve 11 opens. The deflector 34 can thereby help to reduce variations in the operation of the fuel injector 1. The deflector 34 is formed from a rigid material, typically a metal, having a thickness of approximately 0.3 mm. In the present embodiment the deflector 34 is in the form of a cup comprising an annular section 35 and a cylindrical sidewall 36. The deflector 34 is formed from sheet metal, for example by press-forming the metal to form the cup. The annular section 35 extends substantially radially outwardly from the longitudinal axis X of the control valve 11. An underside of the annular section 35 is spaced apart from a bottom of the armature chamber 28 by a longitudinal offset H which is typically in the range 0.3 mm to 0.4 mm inclusive. The longitudinal offset H should be sufficient to limit cavitation in the first sub-chamber 40. In the present embodiment, the longitudinal offset H is 0.3 mm. The bottom of the armature chamber 28 is substantially perpendicular to the longitudinal axis X. The annular section 35 comprises a central aperture 37 through which the control valve member 12 extends. The central aperture 37 is a circle centred on the longitudinal axis X of the control valve member 12 and having an internal diameter Din. A diameter Dstem of the stem 18 coincident with the annular section 35 of the deflector 34 is less than the internal diameter Din of the central aperture 37. Thus, a first aperture 38 is formed between the stem 18 and the deflector 34. The first aperture 38 is annular. The internal diameter Din of the central aperture 37 is typically in the range 2.3 mm to 2.8 mm. More particularly, the internal diameter Din of the central aperture 37 is in the range 2.4 mm to 2.6 mm (clearance 182.5 μm). In the present embodiment, the internal diameter Din is 2.6 mm and the diameter Dstem of the stem 18 is 2.235 mm. Thus, the first aperture 38 has a radial width of approximately 0.1825 mm. A first clearance gap j1 is formed between the deflector 34 and the actuator 24 (more particularly an actuator sleeve 39). The first clearance gap j1 is formed between the cylindrical sidewall 36 of the deflector 34 and the valve body 14. In the present embodiment the first clearance gap j1 (measured parallel to the longitudinal axis X) is approximately 0.05 mm. The first clearance gap j1 promotes fluid circulation around the deflector 34.

The deflector 34 divides the armature chamber 28 into first and second sub-chambers 40, 41. The first and second sub-chambers 40, 41 are annular and arranged concentrically about the longitudinal axis X of the control valve 11. The first sub-chamber 40 is formed between the deflector 34 and the valve body 14; and the second sub-chamber 41 is formed between the deflector 34 and the armature 26. As shown in FIG. 2, the control valve 11 opens into a radially inner end of the first sub-chamber 40. A radially outer end of the first sub-chamber 40 is in fluid communication with the backleak circuit 25. The first and second sub-chambers 40, 41 remain in fluid communication via the first aperture 38 and the first clearance gap j1 to facilitate circulation of fuel.

The bore 23 extends through the control valve member 12 and establishes fluid communication between the collection chamber 31 and the second spring chamber 30. Furthermore, the actuator 24 and the armature 26 are configured to maintain fluid communication between the second spring chamber 30 and the armature chamber 28. In particular, a second clearance gap j2 is maintained between an upper face 42 of the armature 26 and an opposing face 43 of the actuator 24 when the valve face 19 is lifted from the control valve seat 20. The second clearance gap j2 facilitates fluid circulation through the bore 23 formed in the control valve member 12 from the control valve leakages and the backleak circuit. The size of the second clearance gap j2 can be set by appropriate positioning of a lift stop (not shown) to limit travel of the control valve member 12 when the actuator 24 is energized. The second clearance gap j2 (measured parallel to the longitudinal axis X) in the present embodiment is 0.01 mm and 0.06 mm.

The backleak circuit 25 is operative to return fuel from the control valve 11 to a reservoir, such as a fuel tank. Variants of the fuel injector 1 can incorporate different configurations of the backleak circuit 25 and these variants will now be described with reference to FIGS. 4A-C. The configuration of the deflector 33 is unchanged in each of these variants.

Figures 4A, 4B, 4C, 4D:
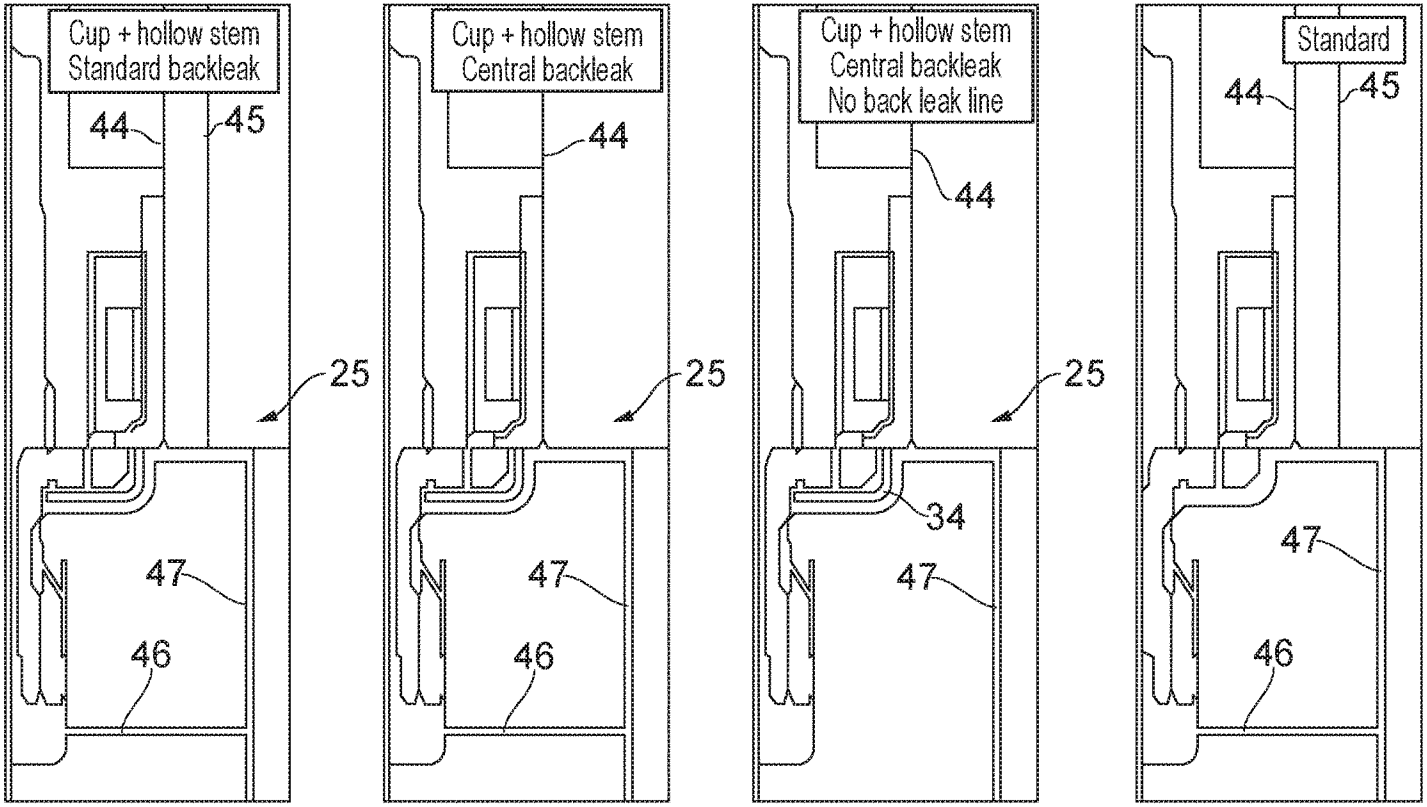
FIG. 4A shows a first variant of the fuel injector in accordance with the present invention.
FIG. 4B shows a second variant of the fuel injector in accordance with the present invention.
FIG. 4C shows a third variant of the fuel injector in accordance with the present invention.
FIG. 4D shows a fuel injector without a deflector.

With reference to FIG. 4A, a first variant of the fuel injector 1 includes a backleak circuit 25 comprising first and second fuel return lines 44, 45, a back leak line 46 and a nozzle return line 47. In this configuration, the first return line 44 functions as a dead volume between the actuator 24 and the injector body 2. The longitudinal bore 23 through the control valve member 12 places fluid communication between the collection chamber 31 and the second spring chamber 30. The first clearance gap j1 maintains fluid communication between the first and second sub-chambers 40, 41, thereby promoting circulation when the control valve member 12 is lifted. The second clearance gap j2 maintains fluid communication between the second spring chamber 30 and the armature chamber 28. The back leak line 46 extends between the collection chamber 31 and the nozzle return line 47.

With reference to FIG. 4B, a second variant of the fuel injector 1 includes a backleak circuit 25 comprising a single fuel return line 44, a back leak line 46 and a nozzle return line 47. The first clearance gap j1 maintains fluid communication between the first and second sub-chambers 40, 41 when the control valve member 12 is lifted. The second clearance gap j2 maintains fluid communication between the second spring chamber 30 and the armature chamber 28. The back leak line 46 extends between the collection chamber 31 and the nozzle return line 47 which is connected to the fuel return line 44.

With reference to FIG. 4C, a third variant of the fuel injector 1 includes a backleak circuit 25 comprising a single fuel return line 44. The back leak line 46 is omitted in this variant. The first clearance gap j1 maintains fluid communication between the first and second sub-chambers 40, 41 when the control valve member 12 is lifted. The second clearance gap j2 maintains fluid communication between the second spring chamber 30 and the armature chamber 28. The nozzle return line 47 is connected to the fuel return line 44 and the armature chamber 28.

The operation of the fuel injector 1 will now be described. When the actuator 24 is energized, the control valve member 12 is displaced and the valve face 19 lifts from the control valve seat 20. The control chamber 13 is thereby placed in fluid communication with the backleak circuit 25. The first spring chamber 10 is connected to the control chamber 13 resulting in a reduction in the fuel pressure in the first spring chamber 10. The fuel pressure in the injector nozzle 3 is higher than the fuel pressure in the first spring chamber 10 and a hydraulic force is applied to the injector needle 4 which overcomes the bias of the first spring 9. The injector needle 4 lifts from the nozzle seat 6 and fuels the injection apertures 8 such that high pressure fuel is injected into the combustion chamber. When the actuator 24 is de-energized, the control valve 11 is closed. The fuel pressure in the injector nozzle 3 and the first spring chamber 10 equalises and the first spring 9 biases the injector needle 4 to a seated position in which the injection apertures 8 are not fuelled.

Figure 5:
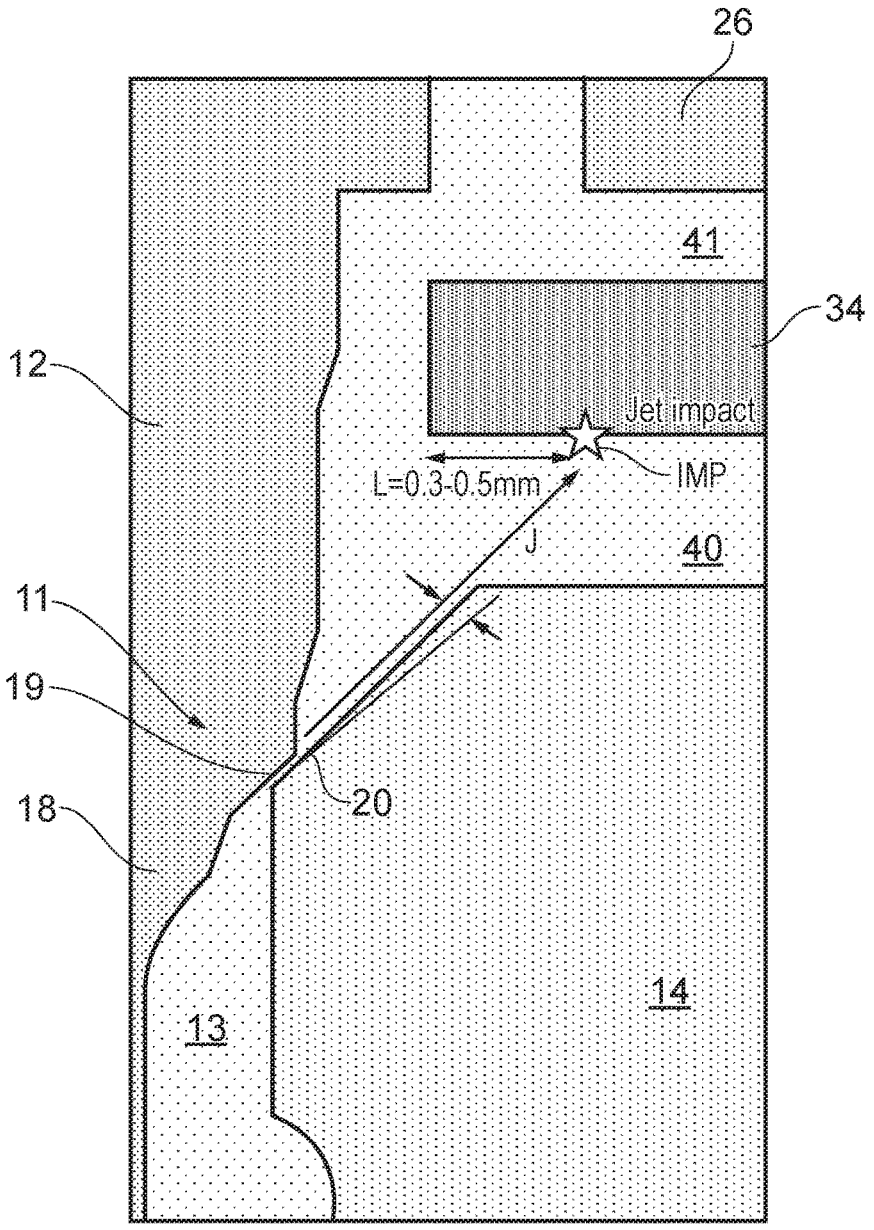
FIG. 5 shows a schematic representation of the formation of a jet of fuel in the first sub-chamber when the control valve member lifts.

With reference to FIG. 5, the opening of the control valve 11 allows high pressure fuel in the control chamber 13 to exit into the first sub-chamber 40 formed in the armature chamber 28. The valve face 19 and the control valve seat 20 form a convergent-divergent section which converts pressure energy into kinetic energy by accelerating the fuel through the constriction. A jet of fuel is introduced into the first sub-chamber 40 from the control chamber 13. The jet of fuel is represented schematically in FIG. 5 by an arrow J. The jet impacts on a lower surface of the deflector 34. The first aperture 38 is disposed radially inwardly from the location at which the jet impacts the deflector 34 (referred to herein as the jet impact location and denoted by the reference IMP in FIG. 5). By ensuring that the jet impact location is spaced apart from the first aperture 38, the Venturi effect can establish a low pressure region proximal to the first aperture 38. In the present embodiment a radial distance L between the jet impact location and the first aperture 38 is in the range 0.3 mm-0.5 mm. The resulting low pressure region promotes the flow of fuel from the second sub-chamber 41 into the first sub-chamber 40 via the first aperture 38. As a result, there is increased fuel flow through the second sub-chamber 41 between the armature 26 and the deflector 34. The operation of the first, second and third variants of the fuel injector 1 will now be described. It will be appreciated that the angle of the fuel jet in the first sub-chamber 40 is determined by the configuration of the control valve 11, for example the angle of the control valve seat 20. In the present embodiment, the control valve seat 20 has a differential seat angle of 8°.

Figures 6A, 6B, 6C, 6D:
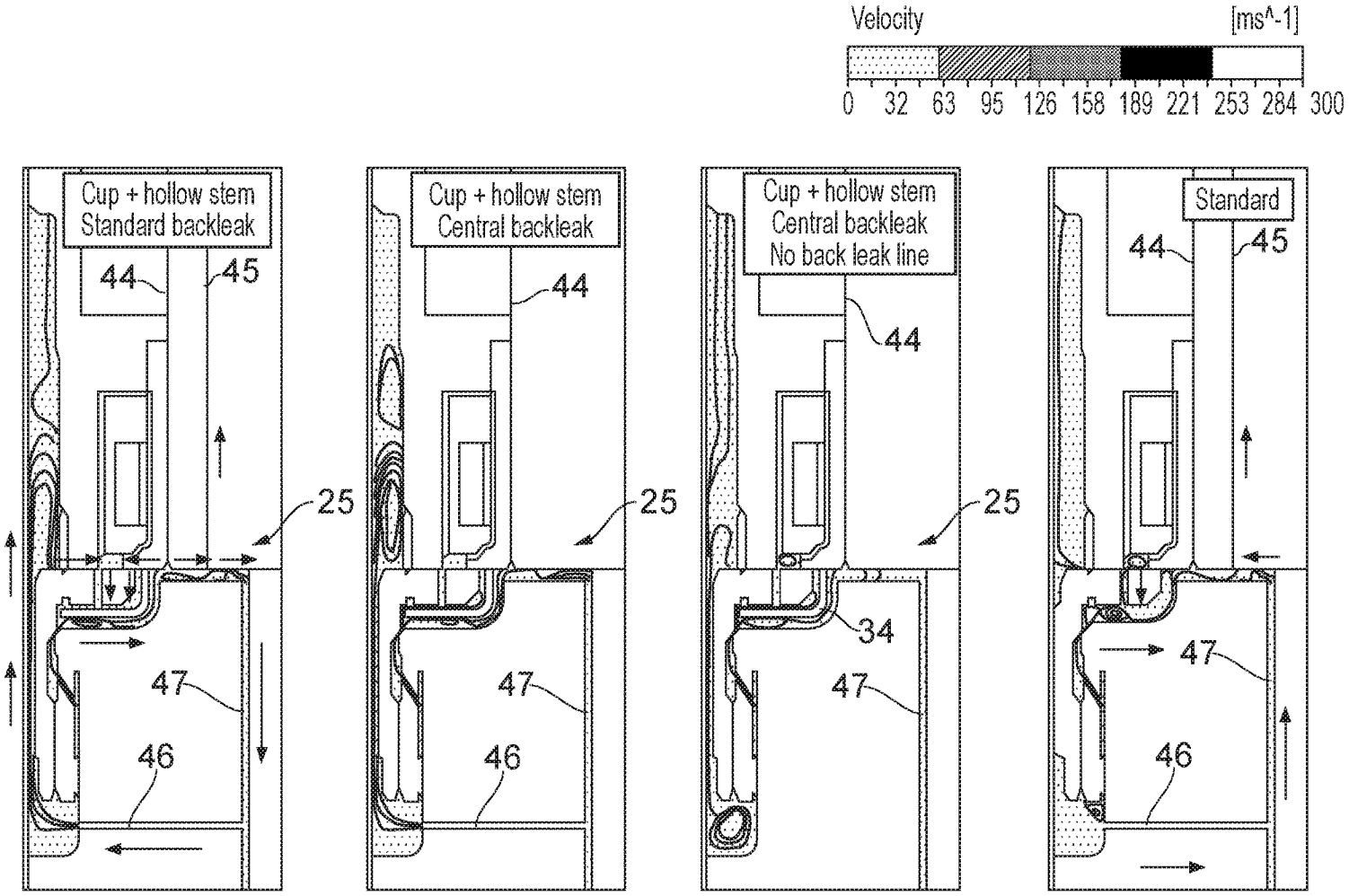
FIG. 6A shows a simulation of velocity and streamlines in a first variant of the fuel injector in accordance with the present invention.
FIG. 6B shows a simulation of velocity and streamlines in a second variant of the fuel injector in accordance with the present invention.
FIG. 6C shows a simulation of velocity and streamlines in a third variant of the fuel injector in accordance with the present invention.
FIG. 6D shows a simulation of the velocity and streamline in a fuel injector without a deflector.
Figures 7A, 7B, 7C, 7D:
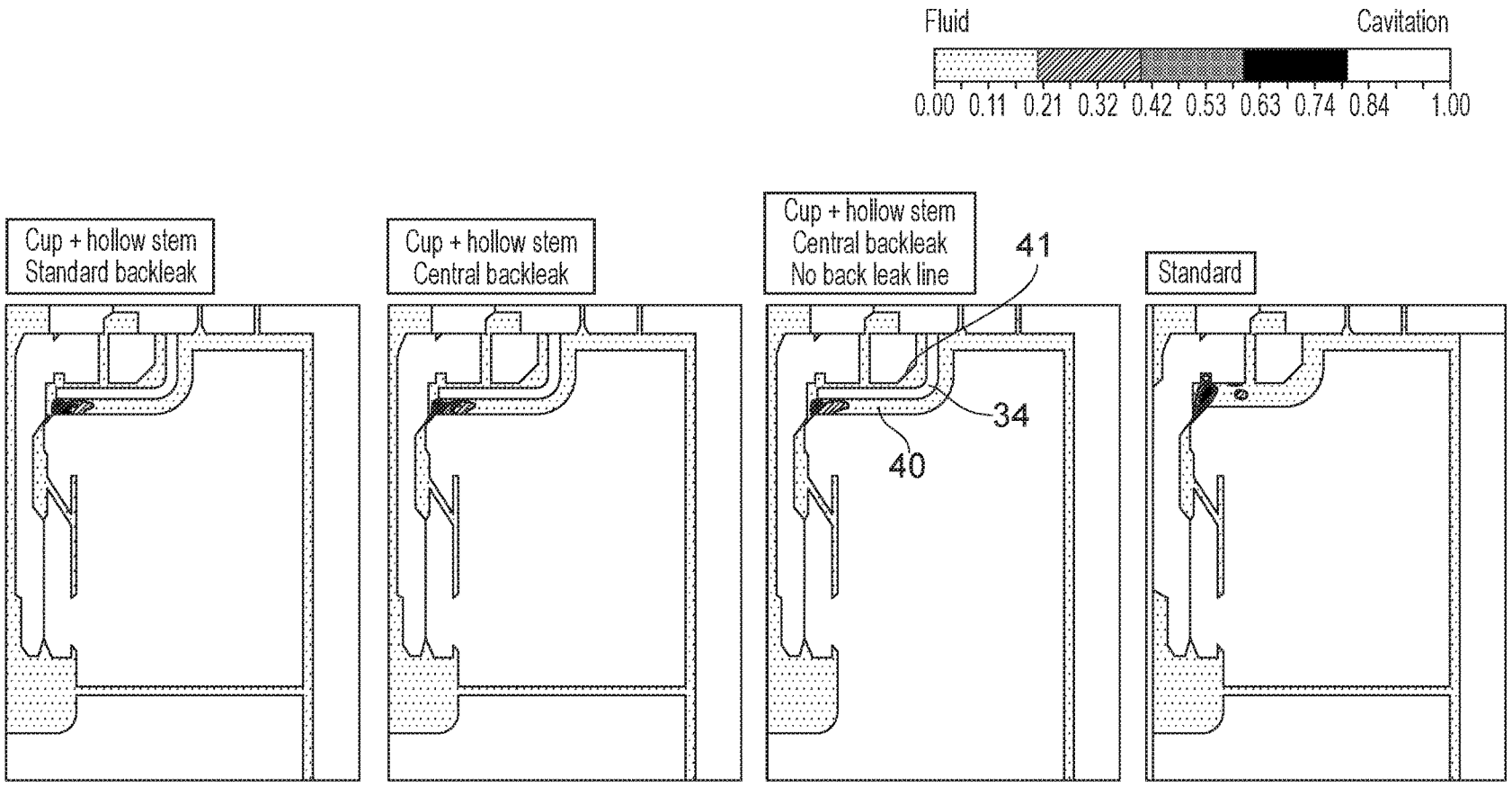
FIG. 7A shows a simulation of cavitation in the first variant of the fuel injector.
FIG. 7B shows a simulation of cavitation in the second variant of the fuel injector.
FIG. 7C shows a simulation of cavitation in the third variant of the fuel injector.
FIG. 7D shows a simulation of cavitation in a fuel injector without a deflector.
Figure 8B:
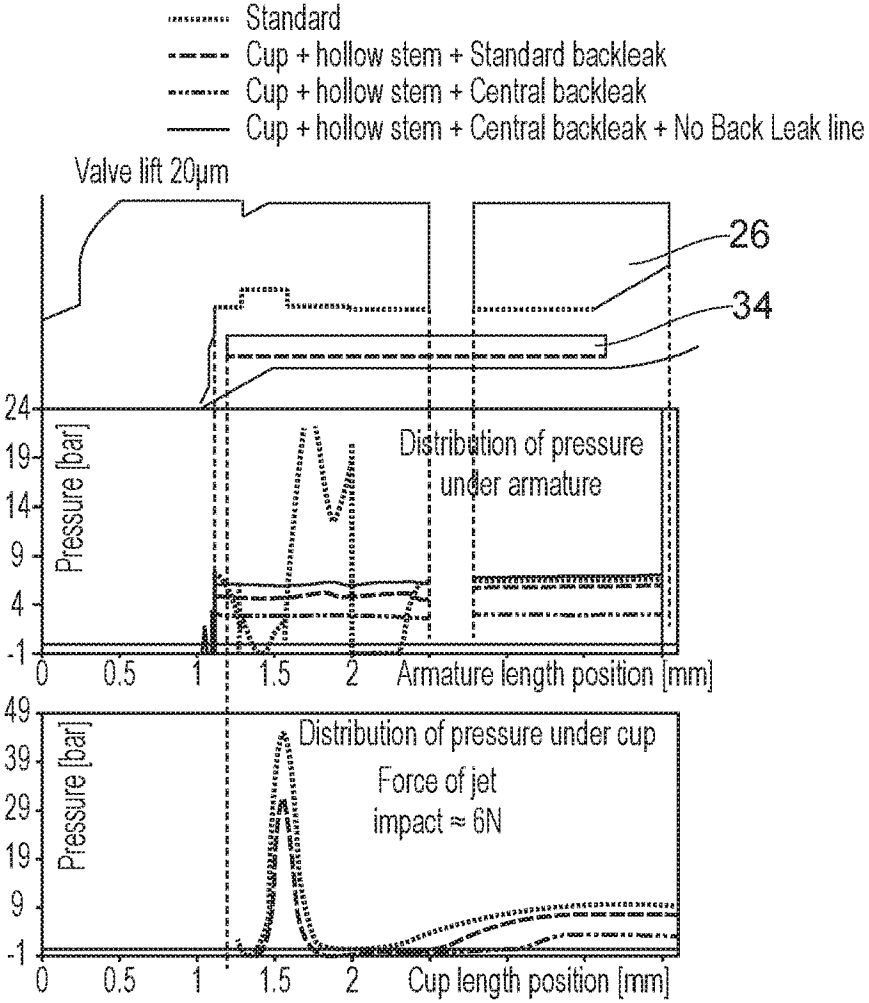
FIG. 8B shows a pressure and force plot for valve lift of 20 μm for each of the variants of the present invention.
Figure 8A:
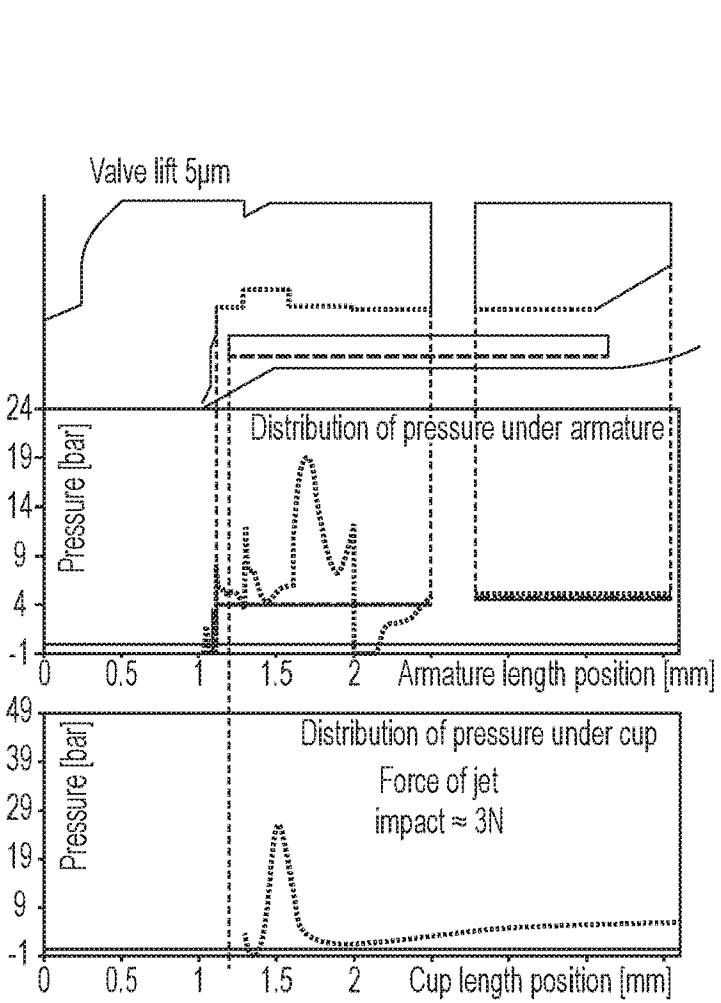
FIG. 8A shows a pressure and force plot for valve lift of 5 μm for each of the variants of the present invention.

The operation of the control valve 11 has been modelled using computational fluid dynamic (CFD) simulation at a rail pressure of 2200 bar with backleak pressure of 5 bar. The results of this simulation are provided in FIGS. 6, 7 and 8. The streamlines within the first, second and third variants of the control valve 11 for a valve lift of 20 μm are shown in FIGS. 6A, 6B and 6C respectively. The flow direction within the control valve 11 is illustrated by arrows. For comparative purposes, FIG. 6D shows the streamlines and flow direction within a control valve having a closed control valve member (i.e. which does not include a longitudinal bore) and which does not include a deflector. Corresponding images illustrating cavitation within the first, second and third variants of the control valve 11 for a valve lift of 20 μm are shown in FIGS. 7A, 7B and 7C. Again, for comparative purposes, FIG. 7D illustrates cavitation within a control valve having a closed control valve member (i.e. which does not include a longitudinal bore) and which does not include a deflector. The pressure and force at radial positions under the armature 26 and under the deflector 34 for valve lifts of 5 μm and 20 μm are illustrated in FIGS. 8A and 8B respectively.

With reference to FIG. 6A, the first variant of the control valve 11 comprises first and second fuel return line 44, 45. In this configuration, the first return line 44 functions as a dead volume between the actuator 24 and the injector body 2. When the control valve member 12 lifts from the control valve seat 20, a venturi is formed in the first sub-chamber 40 proximal to the control valve seat 20. The resulting low pressure region promotes the flow of fuel from the second sub-chamber 41 into the first sub-chamber 40. Fuel from the first sub-chamber 40 can exit through the second fuel return line 45. The fuel from the first sub-chamber 41 can also enter the second sub-chamber 41 through the first clearance gap j1. Thus, the deflector 34 facilitates circulation of fuel through the first and second sub-chambers 40, 41. Fuel is drawn into the second sub-chamber 41 from the second spring chamber 30 via the through-flow channels 27. This facilitates the circulation of fuel from the collection chamber 31 into the second spring chamber 30 via the longitudinal bore 23 formed in the control valve member 12. In the orientation shown in FIG. 6A, the fuel flows upwardly through the longitudinal bore 23 into the second spring chamber 30 and exits via the second clearance gap j2.

With reference to FIG. 6B, the second variant of the control valve 11 comprises a single fuel return line 44. When the control valve member 12 lifts from the control valve seat 20, a venturi is formed in the first sub-chamber 40 proximal to the control valve seat 20. The resulting low pressure region promotes the flow of fuel from the second sub-chamber 41 into the first sub-chamber 40. Fuel from the first sub-chamber 40 can exit through the fuel return lines 44. The fuel from the first sub-chamber 41 can also enter the second sub-chamber 41 through the first clearance gap j1. Fuel is drawn into the second sub-chamber 41 from the second spring chamber 30 via the through-flow channels 27. In the orientation shown in FIG. 6B, the fuel flows upwardly through the longitudinal bore 23 into the second spring chamber 30 and exits via the second clearance gap j2. The velocity of the fuel within the second spring chamber 30 may be higher in the second variant than for the first variant. Similarly, the velocity of the fuel flow through the first sub-chamber 40 may be greater in the second variant.

With reference to FIG. 6C, the third variant of the control valve 11 comprises a single fuel return line 44. Moreover, the control valve 11 according to the third variant omits the back leak line 46. When the control valve member 12 lifts from the control valve seat 20, a venturi is formed in the first sub-chamber 40 proximal to the control valve seat 20. The resulting low pressure region promotes the flow of fuel from the second sub-chamber 41 into the first sub-chamber 40. Fuel from the first sub-chamber 40 can exit through the fuel return line 44. The fuel from the first sub-chamber 41 can also enter the second sub-chamber 41 through the first clearance gap j1. Thus, the deflector 34 facilitates circulation of fuel through the first and second sub-chambers 40, 41. Fuel is drawn into the second sub-chamber 41 from the second spring chamber 30 via the through-flow channels 27. It will be noted that there is increased circulation of the fuel within the collection chamber 31 in this variant. At least in certain embodiments, the omission of the back leak line 46 can reduce the temperature at the bottom of the control valve member 12.

The deflector 34 forms first and second sub-chambers 40, 41 within the armature chamber 28. The control valve seat 20 has a conical profile which defines a divergent section in the flow path from the control chamber 13 into the first sub-chamber 40. In use, a venturi is established in the first sub-chamber 40 proximal to the control valve seat 20. The venturi facilitates circulation of fuel around the armature 26. The resulting circulation within the armature chamber 28 can help to reduce operating temperatures (for example due to viscous heating at the control valve seat 20) and also the accumulation of deposits. The residence time of the fuel within the fuel injector 1 can be reduced, helping to reduce fuel degradation which may otherwise result from fuel stagnation. The first clearance gap j1 facilitates fuel circulation between the first and second sub-chambers 40, 41. The second clearance gap j2 facilitates fuel circulation through the control valve member 12 due to leakage is past the control valve member 12 and the backleak circuit 25.

The inclusion of the deflector 34 can help to reduce or to avoid application of a jet impact force under the armature 26.

It will be appreciated that various changes and modifications can be made to the fuel injector 1 and the control valve 11 described herein without departing from the scope of the present invention.

The invention claimed is:

1. A fuel injector comprising:

a control valve which controls fuel pressure in a control chamber, the control valve comprising:

a valve seat;

a valve member having a valve face for cooperating with the valve seat to control fuel pressure in the control chamber;

a return line for returning fuel from the control chamber;

an armature connected to the valve member, the armature being disposed in an armature chamber;

an actuator for actuating the armature; and a deflector disposed in the armature chamber which forms a first sub-chamber and a second sub-chamber, the first sub-chamber and the second sub-chamber being in fluid communication with each other via at least one first aperture;

wherein, in use, a pressure differential is established between the first sub-chamber and the second sub-chamber when the valve face lifts from the valve seat promoting the flow of fuel from the second sub-chamber into the first sub-chamber through the at least one first aperture, wherein the at least one first aperture is configured to establish communication between radially inner ends of the first sub-chamber and the second sub-chamber, wherein the at least one first aperture is disposed proximal to the valve seat, wherein the at least one first aperture has a radial width in the range 0.0325 mm to 0.2825 mm inclusive.

2. A fuel injector as claimed in claim 1, wherein the at least one first aperture is an annular aperture extending circumferentially around the valve member.

3. A fuel injector as claimed in claim 1, further comprising at least one second aperture which facilitates circulation between the first sub-chamber and the second sub-chamber.

4. A fuel injector as claimed in claim 3, wherein the valve seat and the at least one second aperture are formed at opposing ends of the armature chamber.

5. A fuel injector as claimed in claim 4, wherein the at least one second aperture has a longitudinal dimension of at least 0.05 mm.

6. A fuel injector as claimed claim 1, wherein the control valve opens into the first sub-chamber; and the second sub-chamber is formed between the deflector and the armature.

7. A fuel injector as claimed in claim 1, wherein the valve member comprises a longitudinal bore which is open at a first end and a second end.

8. A fuel injector as claimed in claim 7, wherein the first end of the longitudinal bore opens into a collection chamber; the collection chamber either being closed or connected to the return line.

9. A fuel injector as claimed in claim 7, wherein the second end of the longitudinal bore opens into a chamber above the armature and at least one third aperture is maintained between the actuator and the armature when the control valve is open.

10. A fuel injector as claimed in claim 9, wherein the at least one third aperture comprises a clearance between an upper face of the armature and an opposing face of the actuator.

11. A fuel injector as claimed in claim 10, wherein the clearance between the upper face of the armature and the opposing face of the actuator is between 0.01 mm and 0.06 mm.

12. A fuel injector as claimed in claim 1, wherein an underside of the deflector is spaced apart from a bottom of the armature chamber by a longitudinal offset in the range 0.3 mm to 0.4 mm.

* * * * *